US006438772B1

(12) United States Patent
Brown et al.

(10) Patent No.: US 6,438,772 B1
(45) Date of Patent: Aug. 27, 2002

(54) COLLAPSIBLE PLAY YARD

(75) Inventors: Bryan M. Brown, Buffalo; John S. Canna, Orchard Park; Julia Favorito, Buffalo; Eric T. Shuler, Orchard Park, all of NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/409,699

(22) Filed: Sep. 30, 1999

(51) Int. Cl.[7] ..... A47D 7/00
(52) U.S. Cl. ..... 5/99.1; 5/93.1; 5/98.2
(58) Field of Search ..... 5/99.1, 98.1, 98.2, 5/93.1

(56) References Cited

U.S. PATENT DOCUMENTS

| | | | | |
|---|---|---|---|---|
| 374,277 | A | 12/1887 | Smith | |
| 1,881,579 | A | 10/1932 | Hoch et al. | |
| 2,433,504 | A | 12/1947 | Zimmerman | |
| 2,489,188 | A | 11/1949 | Landry | |
| 2,681,659 | A | 6/1954 | Hrinsin | |
| 2,710,976 | A | 6/1955 | Martensen | |
| 2,908,021 | A | 10/1959 | Fulton | |
| 2,922,169 | A | 1/1960 | Werner | |
| 2,992,441 | A | 7/1961 | Landry | |
| 3,004,793 | A | 10/1961 | Loomis | |
| 3,063,065 | A * | 11/1962 | Shaw | 5/99.1 |
| 3,071,782 | A | 1/1963 | Ball | |
| 3,092,847 | A | 6/1963 | De Puy | |
| 3,115,364 | A | 12/1963 | Berlin | |
| 3,206,772 | A | 9/1965 | Sarasin | |
| 3,206,773 | A | 9/1965 | Sarasin | |
| 3,699,594 | A | 10/1972 | Matthey-Doret | 5/99 |
| 3,886,607 | A | 6/1975 | Dunn | 5/104 |
| 4,070,716 | A | 1/1978 | Satt et al. | 5/99 |
| 4,081,869 | A | 4/1978 | Ash | 5/105 |
| 4,483,026 | A | 11/1984 | Kassai | 5/99 |
| 4,493,120 | A | 1/1985 | Watts | 5/99 |
| 4,499,619 | A | 2/1985 | Kassai | 5/99 |
| 4,510,634 | A | 4/1985 | Diedrich et al. | 5/98 |
| 4,635,305 | A * | 1/1987 | Wyss | 5/99.1 |
| 4,703,525 | A | 11/1987 | Shamie | 5/99 |
| 4,707,024 | A | 11/1987 | Schrader | 297/250 |
| 4,790,340 | A | 12/1988 | Mahoney | 135/90 |
| 4,796,314 | A | 1/1989 | Garduno | 5/98 |
| 4,811,437 | A | 3/1989 | Dillner et al. | 5/99 |
| 4,836,573 | A | 6/1989 | Gebhard | 280/644 |
| 4,837,875 | A | 6/1989 | Shamie et al. | 5/99 |

(List continued on next page.)

FOREIGN PATENT DOCUMENTS

| | | |
|---|---|---|
| DE | 270503 | 1/1950 |
| GB | 463827 | 4/1937 |

OTHER PUBLICATIONS

U.S. Pat. application No. 29/104,989 to Favorito et al. Filed on May 14, 1999.

*Primary Examiner*—Lynne H. Browne
*Assistant Examiner*—Fredrick Conley
(74) *Attorney, Agent, or Firm*—Morgan Lewis & Bockius LLP

(57) ABSTRACT

A play yard has an oval-shaped upper frame. The upper frame is made of two u-shaped tubes and is supported by two vertical posts at either end of the play yard. The ends of each of the u-shaped tubes of the upper frame are connected to each post so as to be able to rotate about the posts. Located on each post is a slider which can slide up and down the post. Each slider is held in place by a button on each post. Diagonal support braces connect the sliders to each of the u-shaped tubes of the upper frame. When the play yard is in use, the upper frame is supported by the two vertical posts and the diagonal support braces located on either side of the play yard. The lower end of each post is connected to two opposing cantilevered legs at a hub. Each of the legs is substantially u-shaped and is pivotally connected at the hub in order to be able to rotate about the posts.

41 Claims, 8 Drawing Sheets

U.S. PATENT DOCUMENTS

| | | | | | |
|---|---|---|---|---|---|
| D304,523 | S | | 11/1989 | Dillner et al. | D6/391 |
| 4,891,852 | A | | 1/1990 | Lopez, Jr. | 5/105 |
| 4,934,025 | A | | 6/1990 | Mariol | 16/347 |
| 5,187,826 | A | | 2/1993 | Mariol | 5/655 |
| 5,193,234 | A | * | 3/1993 | Joaquin | 5/99.1 |
| 5,197,154 | A | | 3/1993 | Shamie | 5/99 |
| 5,269,587 | A | | 12/1993 | Cunningham et al. | 297/42 |
| 5,269,591 | A | | 12/1993 | Miga, Jr. et al. | 297/452.13 |
| 5,339,470 | A | | 8/1994 | Shamie | 5/98.1 |
| 5,485,655 | A | | 1/1996 | Wang | 16/371 |
| 5,517,707 | A | | 5/1996 | LaMantia | 5/97 |
| 5,542,151 | A | | 8/1996 | Stranski et al. | 16/326 |
| 5,560,055 | A | | 10/1996 | Ziegler | 5/99.1 |
| 5,586,345 | A | | 12/1996 | Nielsen et al. | 5/99.1 |
| D383,625 | S | | 9/1997 | DIllner | D6/491 |
| 5,694,655 | A | | 12/1997 | Shepler et al. | 5/105 |
| 5,697,111 | A | | 12/1997 | Dillner et al. | 5/99.1 |
| D390,730 | S | | 2/1998 | Gerhart et al. | D6/491 |
| D393,392 | S | | 4/1998 | Hartenstine | D6/553 |
| 5,813,064 | A | | 9/1998 | Hartenstine | 5/99.1 |
| 5,819,341 | A | | 10/1998 | Simamtob et al. | 5/98.1 |
| 5,819,342 | A | | 10/1998 | Williams | 5/99.1 |
| 5,845,666 | A | | 12/1998 | Messner | 35/133 |
| D404,216 | S | | 1/1999 | Gerhart | D6/391 |
| 5,862,548 | A | | 1/1999 | Gerhart | 5/93.1 |
| 5,867,851 | A | | 2/1999 | Mariol et al. | 5/99.1 |
| 5,904,344 | A | | 5/1999 | Pope et al. | 256/25 |
| 5,916,828 | A | | 6/1999 | Messner | 442/132 |
| D413,025 | S | | 8/1999 | Mariol et al. | D6/331 |
| 6,062,588 | A | | 5/2000 | Cheng et al. | 280/642 |
| 6,062,589 | A | | 5/2000 | Cheng | 280/647 |
| 6,067,676 | A | | 5/2000 | Carnahan et al. | 5/99.1 |
| 6,109,280 | A | | 8/2000 | Custer | 135/116 |

* cited by examiner

COLLAPSIBLE PLAY YARD

BACKGROUND OF THE INVENTION

This invention relates to a collapsible play yard. One common design approach is exemplified by U.S. Pat. No. 5,485,655 to Wang. The disclosed play yard has a rectangular upper frame formed of eight frame members pivoted together at their ends, with two members defining each of the four sides of the upper frame. A hinge lock rotationally fixes the two members on each side with respect to each other in a coaxial relationship. The upper frame is supported at its corners on the upper ends of four vertical posts. A rectangular lower frame, also formed with eight hinged frame members, is coupled to the lower ends of the vertical posts. The lower frame supports a segmented rigid floor assembly, and fabric side wall panels are stretched between the upper and lower frame assemblies and the vertical posts. The posts contact a supporting surface (floor or ground), supporting the play yard. The play yard can be collapsed from its deployed configuration to a stored configuration by releasing the hinge locks on the upper frame members, allowing the sides of the upper frame to fold downwardly in a u-shape. The lower frame members are similarly folded upwardly, and the vertical posts urged radially toward each other and the center of the play yard. The play yard folds into a rectangular package with a height defined by the height of the vertical posts.

U.S. Pat. No. 5,867,851 to Mariol discloses a similar play yard frame, except that the upper and lower frames are triangular and there are accordingly three vertical posts.

Play yards similar to the one disclosed in U.S. Pat. No. 5,485,655 have gained wide acceptance in the market place. However, they suffer from some drawbacks. The frames have many parts, making them more difficult and costly to manufacture. The operation of the frame is complicated, requiring the user to independently release four hinge locks on the upper frame and urge the vertical posts manually. The u-shaped fold of the upper frame sides poses a risk of inadvertent collapse of the frame if the child occupant (or a sibling or parent outside the play yard) bears down on the upper frame. There have been reported incidents of children being entrapped in a collapsed upper frame rail. The hinge locks are therefore the subject of much design attention to reduce the risk that they will inadvertently release. One result is that the hinge locks are often difficult and/or non-intuitive to operate. They are often concealed within a fabric sleeve enclosing the upper frame rail, making it even more difficult to discern their operation.

Another common approach to a play yard frame is exemplified by U.S. Pat. No. 3,063,065 to Shaw. The disclosed frame includes two u-shaped upper frame members pivoted to the apex of a triangular vertical support structure. The support structure includes on each side of the frame a central vertical post and a pair of downwardly and outwardly diverging legs. A pair of articulated links are pivoted to the upper frame sides and to the vertical post to support the upper frame. To collapse the frame, the linkages are folded, and the upper frame members rotated downwardly about the vertical support structure. The legs are also pivoted toward the post, producing a relatively flat rectangular folded configuration.

The frame design disclosed in U.S. Pat. No. 3,063,065 also suffers from drawbacks, including a relatively complex fold, and relatively large folded dimensions that are dictated in part by the length of the diagonal legs.

Existing play yard designs, including the designs described above, are typically fairly rigid structures intended not to move or shift when the infant occupant moves about in the play yard. A child occupant is therefore simply confined within the play yard, and derives little play value from the play yard itself.

SUMMARY OF THE INVENTION

The present invention is able to overcome some of the shortcomings of other play yards through a combination of unique design features. One such example is a play yard having an oval-shaped upper frame. The upper frame is made of two u-shaped tubes and is supported by two vertical posts at either end of the play yard. The ends of each of the u-shaped tubes of the upper frame are connected to each post so as to be able to rotate about the posts. Located on each post is a slider which can slide up and down the post. Each slider is held in place by a button on each post. Diagonal support braces connect the sliders to each of the u-shaped tubes of the upper frame. When the play yard is in use, the upper frame is thus supported by two vertical posts and the diagonal support braces located on either side of the play yard. The lower end of each post is connected to two opposing cantilevered legs at a hub. Each of the legs is substantially u-shaped and is pivotally connected at the hub in order to be able to rotate about the posts. The legs each have pairs of foot pads and foot stabilizers.

The play yard may be folded into a planar-like shape by pressing the buttons associated with the sliders and moving the sliders downwardly. Doing so allows for the upper frame to collapse towards the two posts. Similarly, the legs are folded upwardly towards the post. Both the upper frame and the legs are continually folded until the play yard reaches a planar-like configuration.

These design features, among others, help the present play yard achieve a number of advantages. The disclosed play yard has a frame design where inadvertent collapse has been minimized. A stable frame has also been provided to eliminate the risk that the play yard will slip and tip over. The play yard is both comfortable and entertaining for the child. One such entertaining feature is that the play yard may bounce slightly as the child moves about in the play yard. The play yard is also very convenient for parents. It can be used indoors or outdoors and is very easy to collapse, store, and transport.

DETAILED DESCRIPTION OF THE INVENTION

The following is a description of the preferred embodiments of the invention.

Figure 1:
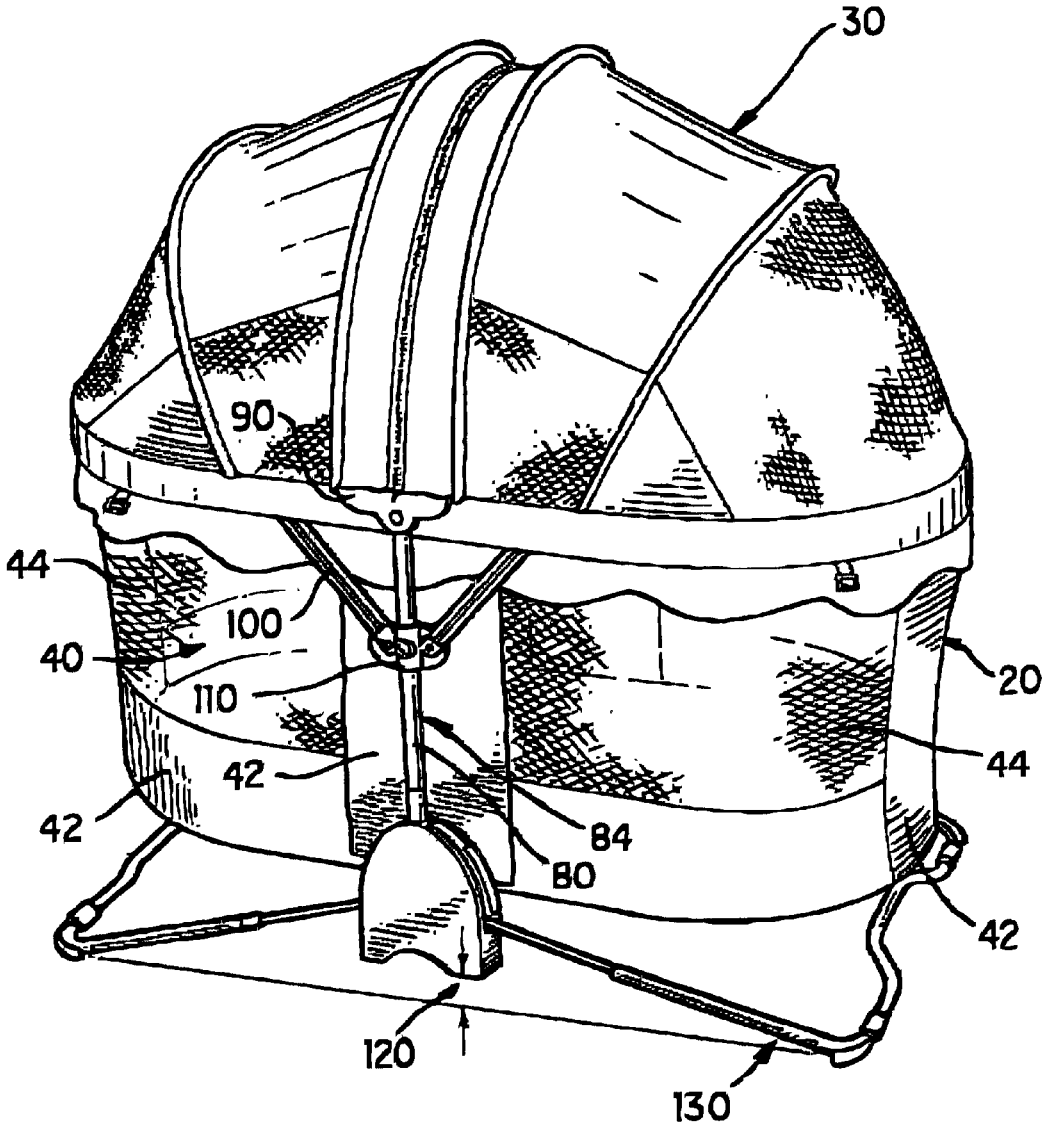
FIG. 1 is a perspective view of a collapsible play yard in its deployed state on which a closed canopy is mounted.
Figure 2:
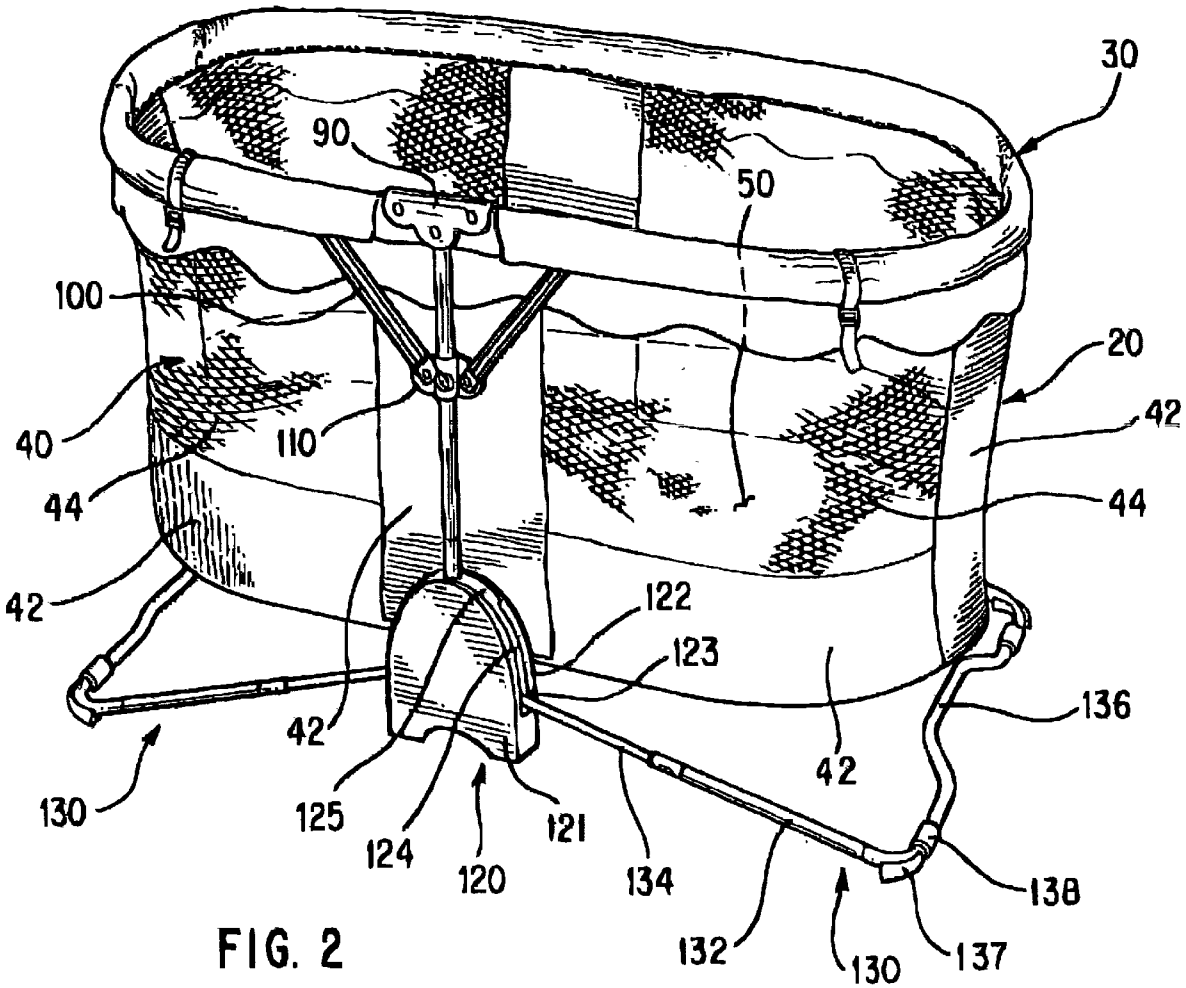
FIG. 2 is a perspective view of the play yard in its deployed state with the canopy opened such that the canopy is located around the outside edge of the upper portion of the play yard.

FIGS. 1 and 2 are front perspective views of a collapsible play yard 20 in its deployed position. As seen in FIG. 1, a zip-up dome canopy 30 may be attached to the play yard 20. The canopy 30, like the play yard 20, is collapsible, and as is seen in FIG. 2 falls to the outside of the edge of the upper portion of the deployed play yard 20 when it is not in use.

with reference to FIG. 2, the side of the play yard 20 is formed from an oval-shaped wall 40 having opaque portions 42 and transparent portions 44. The opaque portions 42 and transparent portions 44 may be made of, respectively, nylon and mesh. The nylon portions 42 in FIG. 2 are along the ends of the wall 40, with the mesh portions 44 located in between the nylon portions 42. It should be recognized that there are many possible arrangements for the opaque 42 and transparent 44 portions other than disclosed in FIG. 2. For instance, one half of the wall 40 could be formed solely of an opaque portion 42, while the other half could be formed solely of a transparent portion 44. It is also possible to attach an opaque material that is capable of folding to the top of the wall 40 at points adjacent to the transparent portions 44. Such an arrangement would allow for the transparent portions 44 to be selectively covered or uncovered.

The play yard 20 also has a floor 50. The floor 50 is suspended to the wall 40 by sewing the nylon outside portion of the floor 50 to the wall 40. In FIG. 2, the floor 50 is oval-shaped and is created by placing an oval-shaped pad on top of the outside portion of the floor 50. The pad is made by capturing three sections of approximately 5 mm. (3/16 inch) thick hardboard (two half circles and one center section) between two layers of nylon, and by placing an approximately 19 mm. (¾ inch) piece of foam on top of the hardboard and below the top layer of nylon. For cleanliness purposes, a removable sheet may be placed on top of the floor 50.

Figure 3:
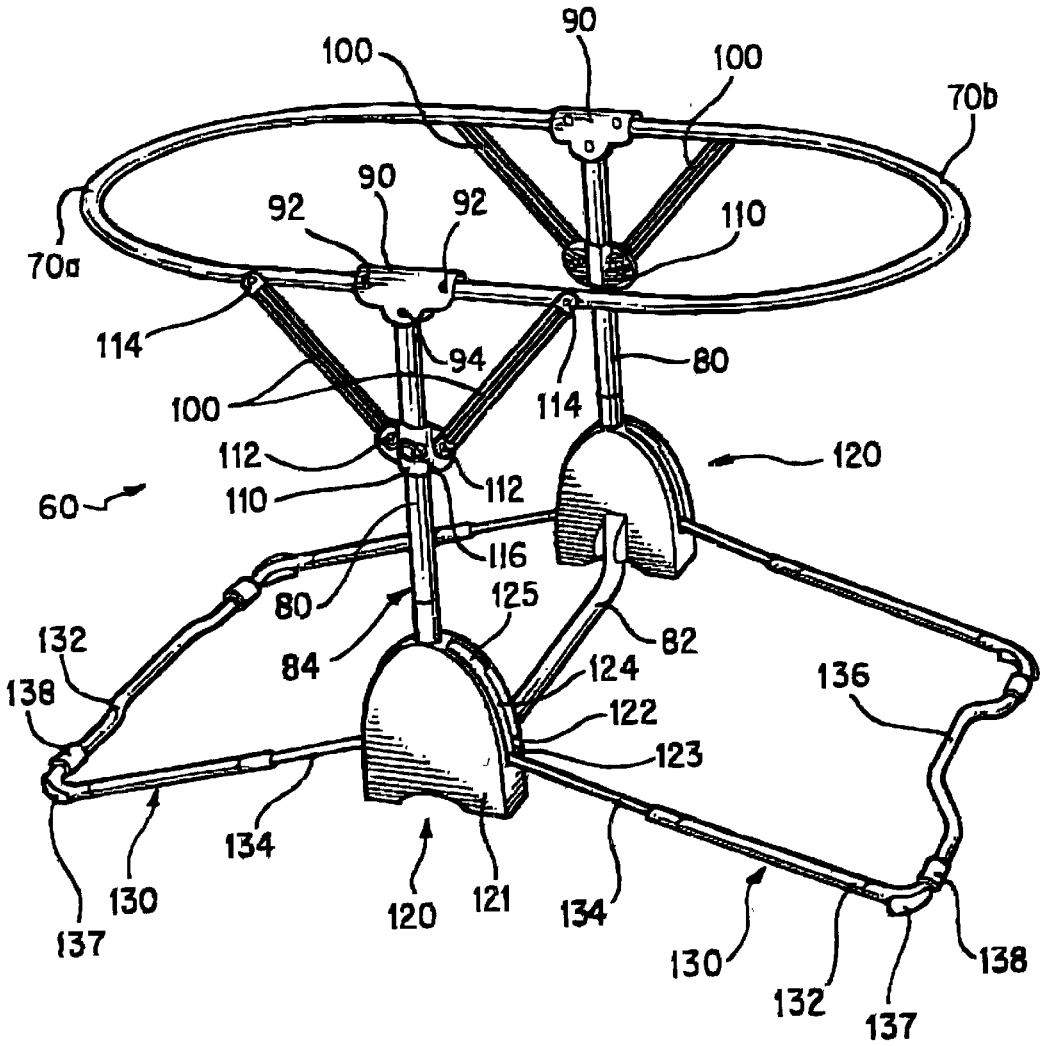
FIG. 3 is a perspective view of the frame structure of the play yard in its deployed state.

The frame 60 of the play yard 20 is disclosed in FIG. 3. The upper frame, a section of which is shown more particularly in FIG. 4, includes two upper frame members 70*a* and 70*b*. The upper frame members 70*a* and 70*b* may be u-shaped and formed of approximately 19 mm. (¾ inch) diameter steel tubing. These u-shaped frame members are ultimately placed in a nylon, padded tunnel formed at the top of the wall 40, and hence act to support the wall 40 and floor 50, which hang from the upper frame members 70*a* and 70*b*. In the alternative, the upper frame could be formed of single or multiple frame members of various sizes and shapes. For instance, a single u-shaped or oval-shaped tube could be utilized to form an asymmetrically-shaped play yard.

The upper frame members 70*a* and 70*b* are coupled to a pair of posts 80 at upper hubs 90, which help support the upper frame members 70*a* and 70*b*. The posts 80 disclosed in FIG. 3 are vertically oriented. The upper hubs 90 shown in FIGS. 3 and 4 include pivot points 92 where the upper hubs 90 connect to the upper frame members 70*a* and 70*b*. The posts 80 connect to the upper hubs 90 at points 94. The upper hubs 90 each form a pair of back-to-back devices into which upper frame members 70*a* and 70*b* are fitted. They may be made of nylon (or other plastic) or elastomeric material. The posts 80 can be formed of approximately 22 mm. (⅞ inch) diameter steel or other material of similar strength, and together in combination with a lower u-shaped member 82, form a single extended u-shaped member 84 that is the center axis of the play yard 20. Note that each post 80 may be formed by mechanically connecting portions of the post 80 to one another to form a single post 80. Alternatively, each post 80 could be an integral structure such that the extended u-shaped member 84 could be a single unitary structure having no mechanical connections. The advantage of having mechanically connected posts 80 is that the play yard can be sold in a smaller package size due to portions of the posts 80 being divided from one another in the packaging. However, such an arrangement requires the consumer to assemble the extended u-shaped member 84.

Figure 4:
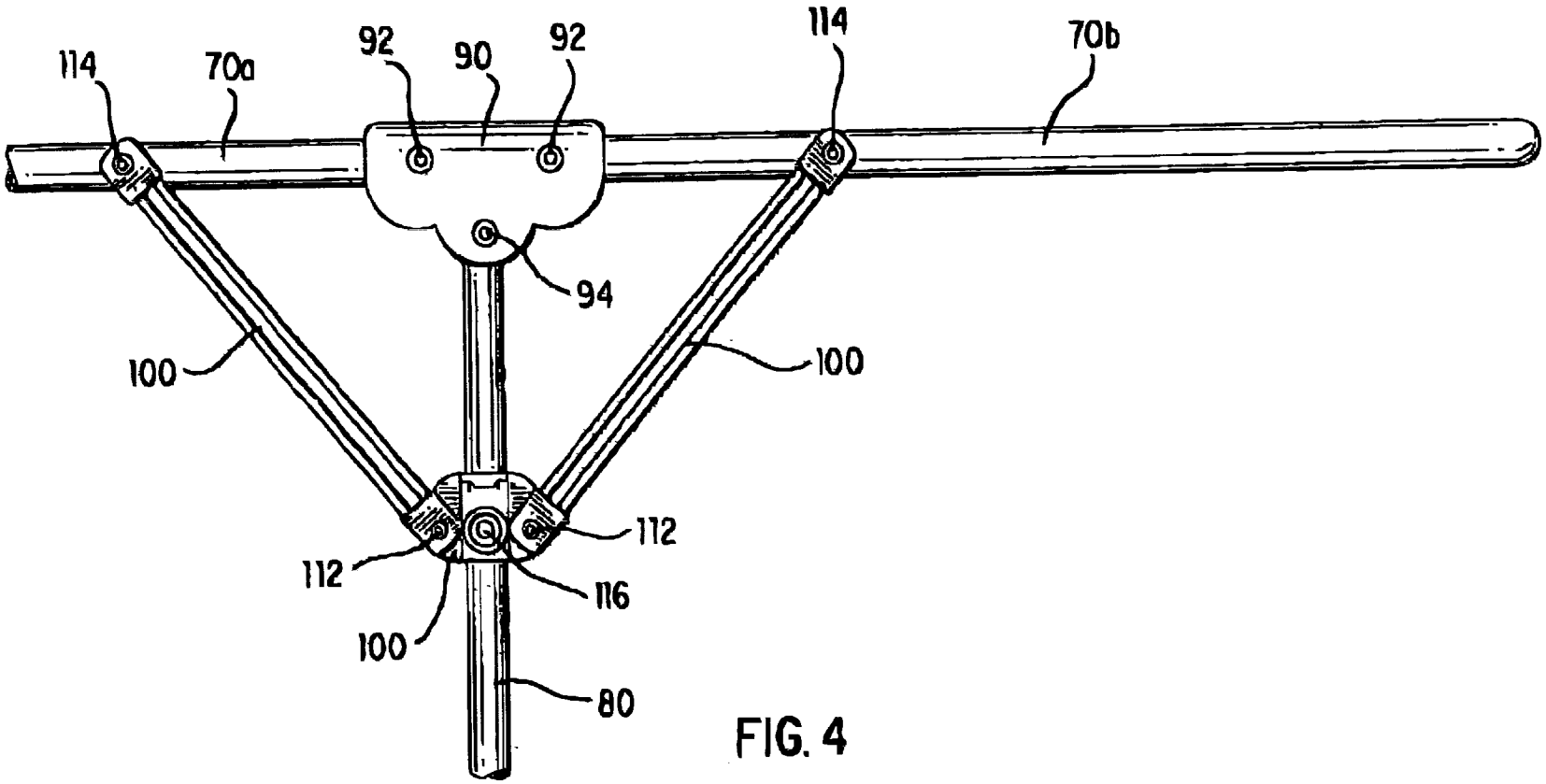
FIG. 4 is a side view of a section of the play yard's upper frame assembly in its deployed state.
Figure 5B:
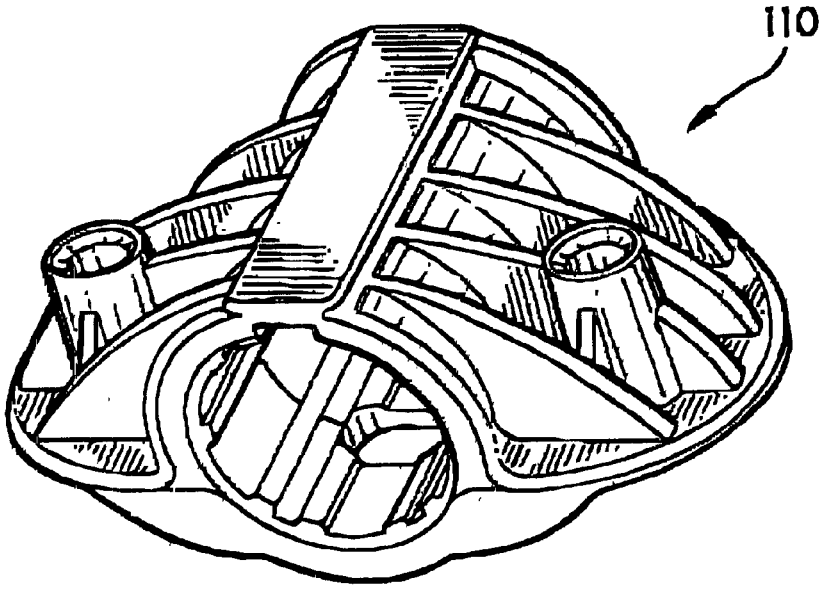
FIG. 5B is a back perspective view of the slider.
Figure 5A:
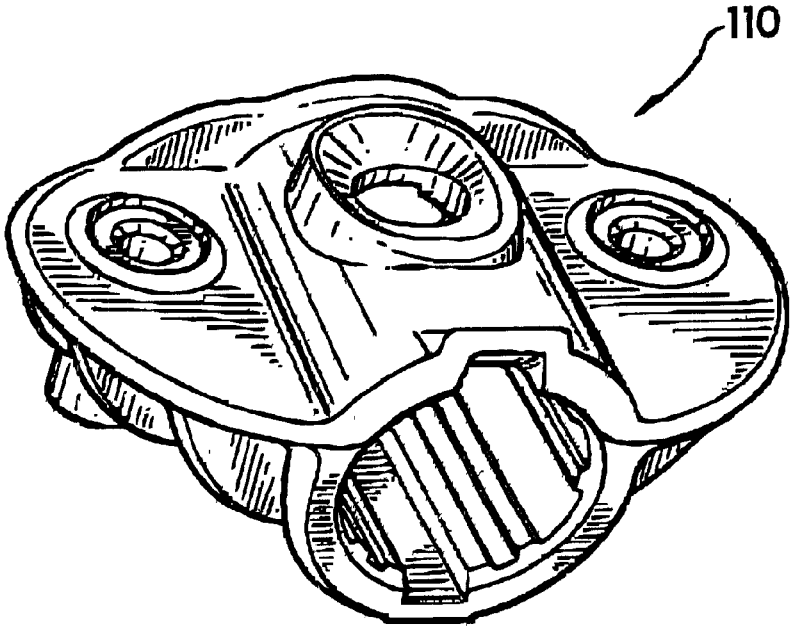
FIG. 5A is a front perspective view of a slider for the play yard.
Figure 6A:
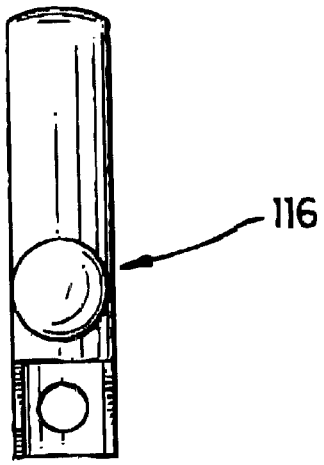
FIG. 6A is a front view of the button.
Figure 6B:
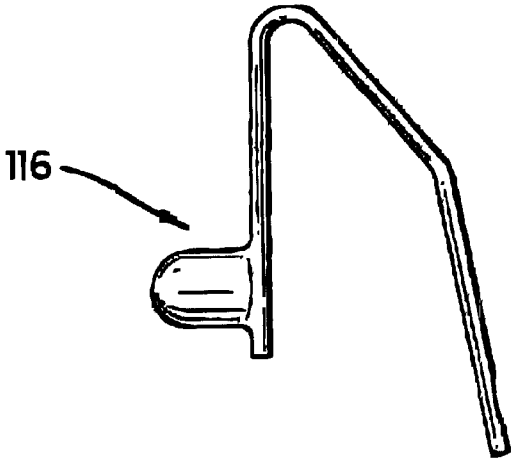
FIG. 6B is a side view of a button for use with the slider.

In addition to being supported at their proximal ends by the upper hubs 90 connected to the posts 80, upper frame members 70*a* and 70*b* are also supported at intermediate pivot points 114 by support members 100. Support members 100, which are shown in FIGS. 3 and 4 as diagonal braces, are pivotally connected to sliders 110 that slide up and down the posts 80. The slider 110 shown in FIGS. 4 and 5 can be made of nylon or other suitable material. The support members 100 are pivotally connected to sliders 110 at points 112. When the upper members 100 are in deployed states, each slider 110 locks into position through the use of a release mechanism 116, which functions to both engage and disengage the sliders 110 from its locked position on post 80. FIG. 3 shows that when the play yard is placed on the ground in this deployed state, the posts 80 are preferably substantially vertical to the ground, and the upper frame members 70*a* and 70*b* are preferably held in a horizontal position. Note that the release mechanism 116 disclosed in FIGS. 4 and 6 is a button, such as those sold under the trademark "VALCO," but other types of release mechanisms 116, such as a latch, could be used to hold each slider 110 in place. Similarly, other structures than that disclosed in FIG. 5 could be used as a slider 110 that is capable of sliding up and down post 80.

Each post is coupled to a ground-engaging base of the play yard 20. In particular, a lower hub 120 is connected to each post 80 at the lower end of each post 80, such lower end being at or near the extreme bottom of the post 80. The type of hub 120 disclosed in FIG. 3 is a nylon housing assembly 120 that is formed from an outer 121 and an inner 122 housing assembly. The outer and inner housing assemblies 121, 122, define lower 123, central 124, and upper grooves 125. Central groove 124 is offset relative to lower groove 123 and upper groove 125 to provide a detent feature as will be described below. Each inner housing assembly 122 may have two small tabs coupled to its inside and located below floor 50 to help support the floor 50.

The housing assembly 120 also serves as a hub and fulcrum point for two opposed cantilevered legs 130. As seen in FIGS. 2 and 3, when the play yard 20 is in its deployed state, the ends of the legs 130, which are pivotally connected to the hub 120, are located in the lower grooves 123 of the two lower hubs 120. The offset of grooves 123 relative to central groove 124 in hub 120 acts as a first detent, locking the legs 130 in the deployed position. The legs 130 can be deflected outwardly away from each other to move them from the first detent in groove 123 and then slid along central groove 124 in hub 120 until they spring back into upper grooves 125, which form a second detent, locking the legs 130 in a folded position. Each leg 130 is substantially u-shaped and can be made of approximately 12 mm. (½ inch) diameter steel substantially u-shaped tubes 132. The tubes 132 have approximately 457 mm. (18 inch) long sections of approximately 10 mm. (⅜ inch) diameter spring steel 134 mechanically fastened to each end (partially inside the tube), forming the resultant leg 130. The deflection of the spring steel 134 ends of the legs 130 helps create a bounce-effect for the frame of the play yard 20. In order to provide more support for the outer ends of the play yard 20, the disclosed legs 130 each have an offset bend 136 in the center. The legs 130 disclosed in FIG. 3 could thus be described as w-shaped in addition to substantially u-shaped. Note that the offset bend 136 is not a necessary feature, and can be more or less pronounced, or eliminated entirely (such that the legs 130 more closely resemble a perfectly u-shaped structure). Note also that, as is the case with the upper frame, the legs 130 can be formed of single or multiple frame members of various sizes and shapes. So, for instance, a single substantially u-shaped or oval shaped tube could be utilized to form an asymmetrically-shaped play yard 120.

For additional stabilization of the play yard 20, each leg 130 can also be equipped with pairs of foot stabilizers 137 and foot pads 138. The foot stabilizers 137 are mechanically attached near each corner of each leg 130 and help prevent the play yard 20 from tipping by providing additional contact points between the legs 130 and the ground. Pairs of foot pads 138, which can be made of thermal plastic elastomer, are mechanically attached to each leg 130 at the points where the legs 130 come into contact with the ground. The pads 138 help stabilize the legs 130 by providing slip resistance for the product. Rollers or wheels could also be attached to the legs 130.

The above-described play yard 20 provides a comfortable and entertaining play space for children. The large enclosure of the play yard 20 gives the child plenty of room to rest and play. Additionally, the mesh and opaque portions of the play yard 20 and canopy 30 allow for the circulation of air and elimination of annoying sunlight and bugs. For added enjoyment, toys can be attached or built-in to the inside of the wall 40 of the play yard 20, and the inside of the wall 40 can be printed with colorful patterns and drawings. Multiple toys can be sewn-on to the wall 40, and can include soft toy animals, each with a different toy feature such as a squeaker, a rattle, a mirror, and a crinkle sound.

Additional entertainment value is derived from the frame design, which allows the play yard 20 to bounce as the child moves about the play yard 20. The bounce produced by the play yard 20 depends on many factors, including the length, thickness, and type of materials used to construct the frame. The disclosed play yard 20 is generally designed for children up to 30 pounds. However, the design of, and materials used to construct, the frame could easily be modified so as to allow for a person of greater weight without compromising the features of invention. Preferably, at no time should the floor 50 of the deployed play yard 20 come into contact with the ground. Hence, because the play yard 20 is designed for children up to 30 pounds, the floor 50 of the play yard 20 should be resting on the supports of the legs 130 even when a weight of 30 pounds is placed on an extreme end of the floor 50. Similarly, the lower hubs 120 should not hit the ground until a weight of 40 pounds is placed on the floor 50. It should be recognized of course that if desired one could make some relatively simple modifications to the frame structure of the play yard 20 so that the lower hubs 120 and the floor 50 touch the ground at a lesser weight (or no weight at all). Such modifications may decrease the bounce produced by the play yard 20.

Besides being entertaining for children, the play yard 20 is very convenient for parents. It can be used both indoors and outdoors, and is collapsed very easily and compactly for transportation and storage purposes. The steps required to collapse the deployed play yard 20 shown in FIG. 1 are easily followed. If closed, the canopy 30 attached to play yard 20 needs to be opened and allowed to fall to the upper outside edge of the wall 40, as disclosed in FIG. 2. The release mechanisms 116, which in this case are buttons, are activated and the sliders 110 moved down the two posts 80, allowing the upper frame members 70*a* and 70*b* to pivot about pivot points 92. As the sliders 110 move down the posts 80 and the upper frame members 70*a* and 70*b* pivot, the ends of the members 70*a* and 70*b* farthest from the post (the distal ends) move down and towards the posts 80. Note that once the release mechanism 116 is activated, the upper frame members 70*a* and 70*b* can be moved by either applying force directly on the sliders 110 or directly on the members 70*a* and 70*b*. As described above, the legs 130 are collapsed by initially slipping the ends of the legs 130 out of the lower grooves 123 of each hub 120. The legs 130 are then moved upwardly, and in doing so the ends of the legs 130 farthest from the post (the distal ends) move upwardly and towards the posts 80. The floor 50 folds in the same direction as the legs 130. If desired, the play yard 20 can be collapsed by performing the above-described steps in varying order. For instance, one could easily begin the collapsing process by first beginning to fold the legs 30, and next by releasing the release mechanism 116.

Figure 7:
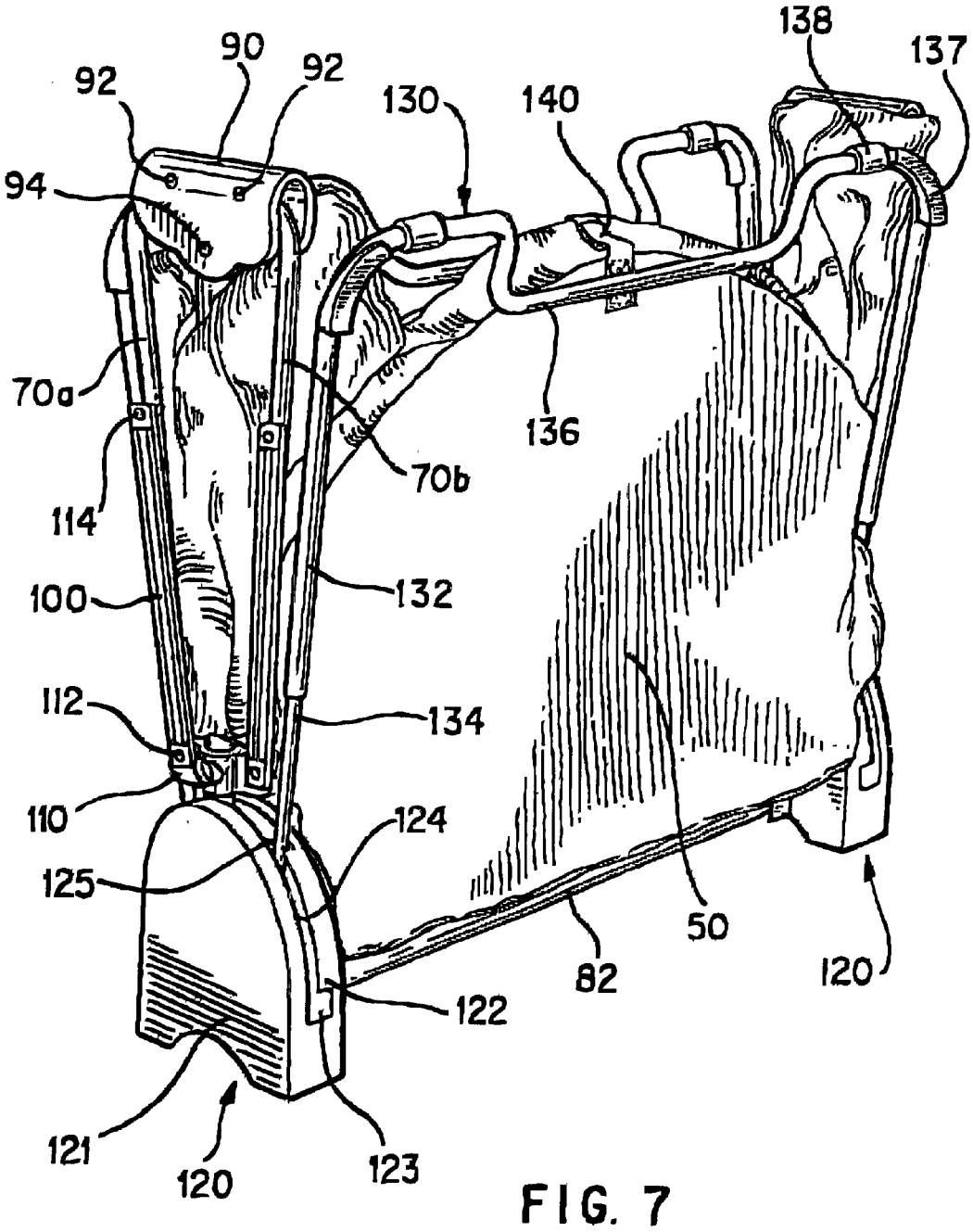
FIG. 7 is a perspective view of the play yard in its collapsed state.
Figure 8:
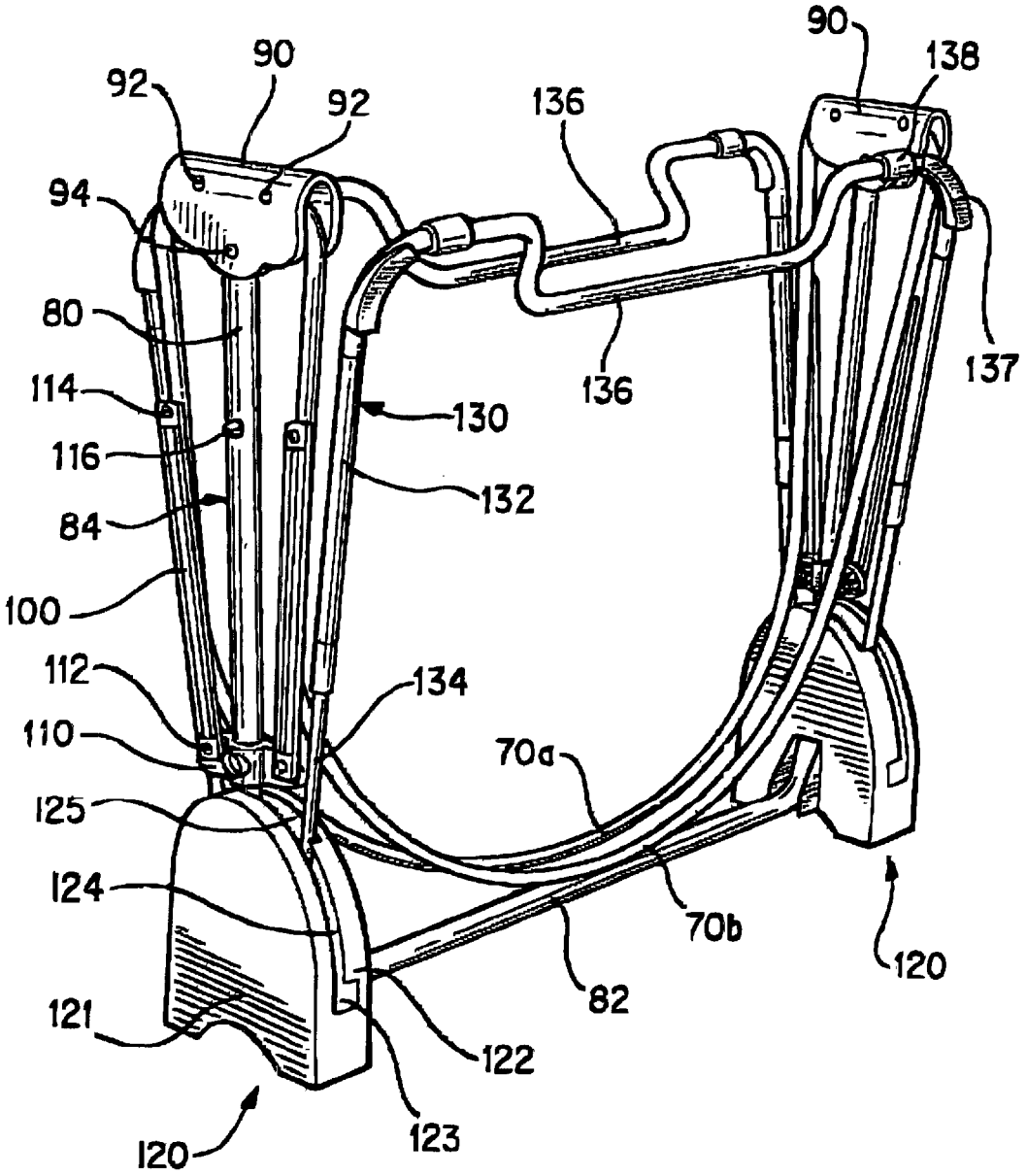
FIG. 8 is a perspective view of the frame of the play yard in its collapsed state.

The ends of the upper frame members 70*a* and 70*b*, the legs 130, and the floor 50 are folded until reaching the position disclosed in FIGS. 7 and 8. In this position, the play yard 20 assumes a compact, planar-like configuration that enables it to be easily transported and stored. As seen in FIGS. 7 and 8, when the play yard 20 is completely collapsed, the sliders 110 are located at or near the top of the lower hubs 120; the upper frame members 70*a* and 70*b* are folded between the posts 80 and the floor 50 such that a portion of each of the upper frame members 70*a* and 70*b* is substantially parallel to the posts 80; and the ends of the legs 130 have moved through the central grooves 124 and are held in place by the upper grooves 125 of the hubs 120. With reference to FIG. 7, straps 140 with VELCRO surfaces can be secured to the bottom outer surface of each end of the floor 50 so as to ensure the floor 50 remains folded after the play yard is collapsed. As seen in FIG. 8, the offset bends 136 of each leg 130 approach one another and act as a handle for carrying the collapsed play yard 20. In order to more easily utilize this handle feature, the folded play yard 20 in FIG. 7 could be altered so that the offset bends 136 of the legs 130 lie above the ends of the floor 50. This allows the offset bends 136 to come into closer proximity to one another so as to make it easier to grasp the handle formed by the bends 136. In the event the distal ends of each leg 130 are not positioned in close enough proximity to act as a handle, carry handles could be added to the folded play yard 20. The handles could be attached to the bottom of each end of the floor 50 such that when the play yard is folded, each handle is lifted up and around the ends of the legs 130 to carry the play yard 20. Note that in order to unfold the legs 130, a force needs to be applied to remove the legs from the upper grooves 125. A spring can be attached to the inside of each hub 120 so that, after removing the legs from the upper grooves 125, the ends of the legs 130 automatically spring into lower grooves 123.

It will be apparent to one of ordinary skill in the art that the invention is not limited to the exact details of construction, design, and operation described above, as modifications can be made to the disclosed structure without departing from the spirit and scope of the invention. Accordingly, the invention is only limited by the appended claims.

What is claimed is:

1. A play yard comprising:

a post;

an upper frame member, coupled to said post at a proximal end of said upper frame member for movement between a first, deployed position in which a distal end of said upper frame member is spaced substantially perpendicular from said post and a second, folded position in which said distal end is adjacent said post;

a slider mounted on said post that can move between an upper position and a lower position; and a support member coupled to said slider and said upper frame member, said support member supporting said upper frame in said deployed position when said slider is in its upper position.

2. The play yard of claim 1, further comprising a second post spaced from said first post, and wherein said upper frame member is u-shaped and is coupled to said posts at the open ends of said u-shaped upper frame member.

3. The play yard of claim 2 further comprising a second u-shaped upper frame member coupled at its open ends to said posts, symmetrically with respect to said first u-shaped upper frame member.

4. The play yard of claim 3 further comprising a second slider disposed on said second post that can move between an upper position and a lower position.

5. The play yard of claim 4, wherein said first and second upper frame members are coupled to said posts by upper hubs.

6. The play yard of claim 5 further comprising a second support member coupled to said second slider and said first and second upper frame members, said second support member supporting said upper frame members in said deployed position when said second slider is in its upper position.

7. The play yard of claim 6, wherein said first and second support members are diagonal braces.

8. The play yard of claim 7 further comprising a means for engaging and disengaging at least one of said sliders.

9. The play yard of claim 8, wherein said means for engaging and disengaging is a release mechanism.

10. The play yard of claim 9 further comprising a base that includes lower hubs coupled to said posts and a leg pivotally coupled to said lower hubs.

11. The play yard of claim 10, wherein said leg is substantially u-shaped and is cantilevered from said hubs.

12. The play yard of claim 11 further comprising a second substantially u-shaped leg symmetrically opposed to said first u-shaped leg and pivotally coupled to, and cantilevered from, said lower hubs.

13. The play yard of claim 1 further comprising a ground engaging leg that is adapted to allow the play yard to bounce upon application of a force when said upper frame member is in its deployed position.

14. The play yard of claim 13, wherein said leg includes at least two segments, the first segment being more elastic than the second segment.

15. The play yard of claim 14, wherein said first segment of said leg is spring steel.

16. The play yard of claim 13, further comprising a lower hub to which said leg is pivotally coupled, and from which said leg is cantilevered.

17. A play yard comprising:

a post;

an upper frame member, coupled to said post at a proximal end of said upper frame member for movement between a first, deployed position in which a distal end of said upper frame member is spaced from said post and a second, folded position in which said distal end is adjacent said post;

a slider mounted on said post that can move between an upper position and a lower position;

a release mechanism selectively engaging said slider and said post to restrain said slider in said upper position; and a support member coupled to said slider and said upper frame member, said support member supporting said upper frame in said deployed position when said slider is in its upper position.

18. The play yard of claim 17, wherein said release mechanism is coupled to said post.

19. The play yard of claim 17, wherein said upper frame member is pivotally coupled at its proximal end to said post.

20. The play yard of claim 19, further comprising a ground engaging base and wherein said post has an upper end and a lower end, said upper end being coupled to said upper frame member, and said lower end being coupled to said base.

21. The play yard of claim 20, wherein said base includes a hub and a ground engaging leg coupled to, and cantilevered from, said hub.

22. The play yard of claim 21, wherein said release mechanism is a button.

23. The play yard of claim 17, wherein said first and second posts are oriented in a substantially vertical direction when said upper frame is in its first position and said ground engaging base is engaged with the ground.

24. A play yard comprising:

a ground engaging base;

first and second support posts coupled at lower ends thereof to said base in laterally spaced relation;

an upper frame coupled to the upper ends of said posts, supported above said base by said posts, and coupled for pivotal movement with respect to said posts between a first position spaced at a substantially perpendicular angle from said posts and a second position angularly proximate said posts; and an enclosure having a floor and a peripheral wall, said enclosure being coupled to said upper frame and suspended therefrom when said upper frame in said first position, with said floor spaced from the ground.

25. The play yard of claim 24 wherein said upper frame includes first and second u-shaped frame portions, each of said frame portions including two laterally spaced proximal ends and a closed distal end, said frame portions being disposed symmetrically about said posts and coupled to said posts at said proximal ends.

26. The play yard of claim 24 further comprising a slider slidably coupled to said first post for translation along said post between an upper position and a lower position and an elongated connector coupled at a first end thereof to said slider and a second, opposite end thereof to said upper frame, said slider being selectively fixable to said post.

27. The play yard of claim 23, wherein said ground engaging base includes a leg that is adapted to allow said enclosure to bounce upon application of a force to said floor when said upper frame is in its first position.

28. The play yard of claim 27, wherein said leg includes at least two segments, the first segment being more elastic than the second segment.

29. The play yard of claim 28, wherein said first segment of said leg is spring steel.

30. The play yard of claim 27, wherein said ground engaging base includes a hub from which said leg is pivotally coupled, and from which said leg is cantilevered.

31. A structure for holding children comprising:

a frame having an upper portion and a lower portion and having an expanded and collapsed condition;

an enclosure having a floor and a wall, said enclosure also having an expanded and collapsed condition and being suspended from said frame;

said frame having a post oriented substantially perpendicular to the floor of the expanded enclosure, said post slidably supporting a support member extending between the upper portion of said frame and said post;

whereby said frame and enclosure assume a collapsed condition when said support member is slid along said post toward the lower portion of said frame.

32. The structure of claim 31 wherein said frame includes a ground engaging leg that is pivotally coupled to said post.

33. The structure of claim 31 wherein said frame includes a pair of legs having proximal ends and distal ends, wherein each of said legs is substantially u-shaped, pivotally connected to said post, and symmetrically opposed to one another.

34. The structure of claim 33 wherein the distal end of one of said legs has an offset bend.

35. A play yard comprising:

two, and only two, support posts that are each coupled to an upper frame and legs, each of said posts having an upper end and a lower end, wherein said legs are coupled to the lower ends of said posts and said upper frame is coupled to the upper ends of said posts;

an enclosure connected to said upper frame having an upper portion and a lower portion;

said legs and upper frame having expanded states in which the legs are capable of engaging the ground and supporting said posts, and said upper frame defines at least a part of an upper portion of said enclosure; and said legs and upper frame having collapsed states in which said legs approach one another to form a handle and at least a portion of said upper frame is in a substantially parallel relationship with at least one of said posts.

36. The play yard of claim 35 wherein said legs are substantially u-shaped.

37. The play yard of claim 36 wherein said substantially u-shaped legs have proximal and distal portions, and wherein the distal portions of said legs have offset bends that form said handles when said legs are in said collapsed state.

38. The play yard of claim 36 wherein said enclosure has expanded and collapsed states, such that when the enclosure is in its expanded state it is capable of holding a child, and the enclosure is in its collapsed state it, along with said collapsed legs and upper frame, forms a planar-like configuration.

39. The play yard of claim 38, further comprising a slider coupled to at least one of said posts that allows said upper frame to convert from said upper frame's expanded state to said upper frame's collapsed state by sliding toward the lower end of said post.

40. A method of collapsing a structure for holding children, the structure having an upper frame and a lower frame interconnected by a post oriented substantially perpendicular from the upper frame when the structure is in its deployed condition, with the post slidably supporting one end of a member connected to the upper frame, the lower frame including a ground engaging leg coupled to the post at a lower end of the post and extending angularly and outwardly therefrom, the method comprising the steps of:

releasing a release mechanism to allow the end of the member to slide along the post; and folding the structure into a planar-like configuration by moving the end of the member toward the lower frame.

41. The method of claim 40 further comprising the steps of folding a distal end of the upper frame member towards the post; and folding a distal end of a ground engaging leg member towards the post.

* * * * *

UNITED STATES PATENT AND TRADEMARK OFFICE

CERTIFICATE OF CORRECTION

PATENT NO. : 6,438,772 B1
DATED : August 27, 2002
INVENTOR(S) : Bryan M. Brown et al.

It is certified that error appears in the above-identified patent and that said Letters Patent is hereby corrected as shown below:

Column 3,
Line 12, “with” should be -- With --;
Line 58, “devices” should be -- clevices --;

Column 8,
Line 56, “claim 23” should be -- claim 24 --; and

Column 10,
Line 10, “and” should be -- and when --.

Signed and Sealed this

Twenty-sixth Day of November, 2002

*Attest:*

*Attesting Officer*

JAMES E. ROGAN
*Director of the United States Patent and Trademark Office*